US011038272B2

(12) United States Patent
Watson et al.

(10) Patent No.: US 11,038,272 B2
(45) Date of Patent: Jun. 15, 2021

(54) CONFIGURABLE ANTENNA ARRAY WITH DIVERSE POLARIZATIONS

(71) Applicants: Paul Robert Watson, Ottawa (CA); Halim Boutayeb, Ottawa (CA); Teyan Chen, Shenzhen (CN); Jingjing Huang, Shenzhen (CN); Tao Wu, Shenzhen (CN)

(72) Inventors: Paul Robert Watson, Ottawa (CA); Halim Boutayeb, Ottawa (CA); Teyan Chen, Shenzhen (CN); Jingjing Huang, Shenzhen (CN); Tao Wu, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 696 days.

(21) Appl. No.: 15/607,595

(22) Filed: May 29, 2017

(65) Prior Publication Data

US 2018/0342807 A1 Nov. 29, 2018

(51) Int. Cl.
*H01Q 9/04* (2006.01)
*H01Q 21/06* (2006.01)
(Continued)

(52) U.S. Cl.
CPC ..... *H01Q 9/0421* (2013.01); *H01Q 3/247* (2013.01); *H01Q 5/42* (2015.01); *H01Q 9/0414* (2013.01); *H01Q 19/10* (2013.01); *H01Q 21/065* (2013.01); *H01Q 21/245* (2013.01); *H01Q 21/26* (2013.01); *H01Q 21/28* (2013.01);
(Continued)

(58) Field of Classification Search
CPC .... H01Q 3/247; H01Q 9/0414; H01Q 9/0421; H01Q 9/0407; H01Q 21/245; H01Q 21/26; H01Q 21/205; H01Q 21/24; H01Q 21/28
See application file for complete search history.

(56) References Cited

U.S. PATENT DOCUMENTS 9,263,798 B1 * 2/2016 Piazza ..... H01Q 3/24
9,799,963 B2 * 10/2017 Huang ..... H01Q 21/062
(Continued)

FOREIGN PATENT DOCUMENTS

CN 1906805 A 1/2007
CN 1922759 A 2/2007
(Continued)

OTHER PUBLICATIONS

ZoneFlex R710 Dual-Band 4x4:4 802.11ac Smart Wi-Fi AP Data Sheet, 2016 Ruckus Wireless, Inc. Company Proprietary Information, 4 pages 2016.
(Continued)

*Primary Examiner* — Ab Salam Alkassim, Jr.

(57) ABSTRACT

A radio frequency (RF) antenna unit that includes a first antenna and a second antenna. The first antenna is positioned on a reflector element, and includes at least three inverted-F antenna (IFAs) elements that are electrically connected to a first RF signal port and that each have an associated tunable element that controls excitation of the IFA element, the tunable elements being operative to control a polarization direction of the first antenna. The second antenna is co-located on the reflector element with the first antenna, and includes a plurality of antenna elements.

19 Claims, 15 Drawing Sheets

(51) Int. Cl.

| | |
|---|---|
| ***H01Q 19/10*** | (2006.01) |
| ***H01Q 3/24*** | (2006.01) |
| ***H01Q 21/24*** | (2006.01) |
| ***H01Q 21/28*** | (2006.01) |
| ***H01Q 5/42*** | (2015.01) |
| ***H01Q 21/26*** | (2006.01) |
| *H01Q 1/38* | (2006.01) |
| *H01Q 21/20* | (2006.01) |
| *H01Q 9/42* | (2006.01) |

(52) U.S. Cl.
CPC ..... *H01Q 1/38* (2013.01); *H01Q 3/24* (2013.01); *H01Q 9/42* (2013.01); *H01Q 21/205* (2013.01)

(56) References Cited

U.S. PATENT DOCUMENTS

| | | | | |
|---|---|---|---|---|
| 2004/0263392 | A1* | 12/2004 | Bisiules | H01Q 1/246 343/700 MS |
| 2005/0237258 | A1* | 10/2005 | Abramov | H01Q 3/24 343/834 |
| 2006/0114168 | A1* | 6/2006 | Gotti | H01Q 1/246 343/797 |
| 2008/0024382 | A1* | 1/2008 | Uddin | H01Q 1/526 343/841 |
| 2009/0135078 | A1 | 5/2009 | Lindmark et al. | |
| 2010/0156747 | A1* | 6/2010 | Montgomery | H01Q 7/00 343/860 |
| 2015/0042513 | A1* | 2/2015 | Foo | H01Q 1/246 342/368 |
| 2015/0042535 | A1* | 2/2015 | Orban | H01Q 1/526 343/841 |
| 2015/0263431 | A1* | 9/2015 | Moon | H01Q 1/246 343/730 |
| 2015/0269400 | A1* | 9/2015 | Poussot | G06K 7/10346 340/10.1 |
| 2015/0349418 | A1* | 12/2015 | Patron | H01Q 3/24 343/836 |
| 2016/0372839 | A1* | 12/2016 | Watson | H01Q 19/108 |
| 2017/0012364 | A1* | 1/2017 | Yang | H01Q 1/52 |
| 2017/0033471 | A1* | 2/2017 | Huang | H01Q 21/26 |
| 2017/0040711 | A1 | 2/2017 | Rakib et al. | |
| 2017/0085009 | A1* | 3/2017 | Watson | H01Q 1/50 |
| 2017/0222318 | A1* | 8/2017 | Li | H01Q 3/24 |
| 2018/0175515 | A1* | 6/2018 | Boutayeb | H01Q 21/26 |
| 2019/0245278 | A1* | 8/2019 | Hsieh | H01Q 3/247 |
| 2020/0028276 | A1* | 1/2020 | Watson | H01Q 21/0025 |

FOREIGN PATENT DOCUMENTS

| | | | |
|---|---|---|---|
| CN | 101228665 | A | 7/2008 |
| CN | 103280630 | A | 9/2013 |
| CN | 104659489 | A | 5/2015 |
| CN | 105789902 | A | 7/2016 |
| CN | 205790338 | U | 12/2016 |
| CN | 106299724 | A | 1/2017 |
| CN | 106450797 | A | 2/2017 |
| JP | 2017085289 | A | 5/2017 |

OTHER PUBLICATIONS

IEEE Antennas and Propagation Society: "IEEE Standard for Definitions of Terms for Antennas",IEEE Standard, IEEE Std 145-2013, Mar. 2014, XP055688902, total 50 pages.

* cited by examiner

CONFIGURABLE ANTENNA ARRAY WITH DIVERSE POLARIZATIONS

TECHNICAL FIELD

The present disclosure relates to configurable antenna arrays with diverse polarizations.

BACKGROUND

Wireless Local Area Networks (WLANs) are utilized for providing users with access to services and/or network connectivity. As a result, compact antenna modules are desirable to provide adaptive beams and multiple beams in WLANs. Many base station or access point antennas deploy arrays of antenna elements to achieve advanced antenna functionality, e.g., beam forming, etc. Thus, solutions for reducing the profile of individual antenna elements as well as for reducing the size (e.g., width, etc.) of the antenna element arrays are desired, while maintaining key performance features such as polarization diversity, high gain in a particular direction, and wide frequency bandwidths.

SUMMARY

Typical existing antennas face challenges in respect of the number of radio frequency streams, peak gain, polarizations and frequency bandwidths they can effectively support within a compact antenna package. Examples described herein can address one or more of these challenges in at least some applications. In at least some examples, an antenna configuration is provided that can support different frequency bands with multiple antenna units, each of which provide selectable polarization diversity.

According to one example aspect is a radio frequency (RF) antenna unit that includes a first antenna and a second antenna. The first antenna is positioned on a reflector element, and includes at least three inverted-F antenna (IFA) elements that are electrically connected to a first RF signal port and that each have an associated tunable element that controls excitation of the IFA element, the tunable elements being operative to control a radiation pattern direction of the first antenna. The second antenna is co-located on the reflector element with the first antenna, and includes a plurality of antenna elements.

In some examples, the tunable elements are operative to control excitation of the IFA elements to enable a first mode in which the first antenna has an omni-directional radiation pattern and a second mode in which the first antenna has a directional radiation pattern. Furthermore, the IFA elements may be arranged symmetrically around a central axis, on a printed surface board (PCB) substrate, and are spaced apart from and parallel to the reflector element.

In some examples, the first RF port is centrally located relative to the IFA elements, each IFA element being electrically connected to the first RF signal port through the tunable element associated with the IFA element such that the tunable element can selectively couple and decouple the IFA element to the first RF signal port. In some configurations, each IFA element may have an associated gain enhancing parasitic conductor that is located adjacent the IFA element on the PCB substrate a further distance from the RF signal port than the IFA element.

In some examples, the antenna elements of the second antenna are each connected to a second RF signal port and each have an associated tunable element that controls excitation of the antenna element, the tunable elements being operative to control a radiation pattern direction of the second antenna. The antenna elements of the second antenna may be centrosymetrically arranged around the central axis, and the antenna elements are each folded monopole antenna elements that extend perpendicular to the reflector element.

In some examples of the first aspect, the first antenna and the second antenna are configured to operate in the same frequency band, for example a 2.4 GHz band or a 5 GHz band. In some examples, the first antenna and the second antenna are configured to operate in different frequency bands, for example one in the 2.4 GHz band and one in the 5 GHz band.

In some examples, the first antenna comprises four IFA elements and the second antenna comprises four folded monopole antenna elements. In some examples, a shorting line of each monopole antenna element is connected to ground through the tunable element associated with the monopole antenna element.

In some alternative configurations, the antenna elements of the second antenna are IFA elements arranged symmetrically around the central axis, on a further PCB substrate, and are spaced apart from and parallel to the reflector element and the PCB substrate of the first antenna.

According to a further aspect, an antenna array is provided that includes a planar reflector element and first and second antenna units that respectively include a first antenna and a second antenna positioned on the reflector element. The first antenna is configured to operate in a first frequency range, and has at least three inverted-F antenna (IFAs) elements electrically connected to a first RF signal port and that each have an associated tunable element that controls excitation of the IFA element. The second antenna is configured to operate in a second frequency range and has at least three inverted-F antenna (IFAs) elements that are electrically connected to a second RF signal port. All of the IFA elements have an associated tunable element that controls excitation of the IFA element. A controller is operatively connected to the tunable elements associated with each of the IFA elements for selectively controlling radiation pattern directions of the first antenna and the second antenna.

In some examples configurations, the tunable elements are responsive to the controller to control excitation of the IFA elements to selectively enable a first and second mode for each of the first and second antennas, wherein in the first mode the IFA elements are excited collectively to provide an omni-directional radiation pattern and in the second mode the IFA elements are selectively excited to provide a directional radiation pattern.

In some examples, the first antenna unit includes a further antenna co-located on the reflector element with the first antenna and comprising at least three antenna elements electrically connected to a third RF signal port and that each have an associated tunable element that controls excitation of the antenna element. Similarly, the second antenna unit includes a further antenna co-located on the reflector element with the second antenna and comprising at least three antenna elements electrically connected to a forth RF signal port and that each have an associated tunable element that controls excitation of the antenna element. The controller is operatively connected to the tunable elements associated with each of the antenna elements for selectively controlling radiation pattern directions of the further antennas of the first antenna unit and the second antenna unit.

In some embodiments of the antenna array, each of the first antenna and the second antenna have their IFA elements arranged symmetrically around a central axis, on a printed surface board (PCB) substrate, and are spaced apart from and parallel to the reflector element. For the first antenna the first RF signal port is centrally located relative to the IFA elements, and each IFA element of the first antenna is connected to the first RF signal port through the tunable element associated with the IFA element. For the second antenna the second RF signal port is centrally located relative to the IFA elements, and each IFA element of the second antenna is connected to the second RF signal port through the tunable element associated with the IFA element.

In some embodiments the antenna array includes two of the first antenna units and two of the second antenna units located symmetrically around a central area of the reflector element, enabling 8 RF signals to be independently polarized.

In some examples of the antenna array, the first antenna and second antenna each include at least four IFA elements and the further antennas of the first antenna unit and the second antenna unit each comprise at least four folded monopole antenna elements.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

Multiple input and multiple output (MIMO) antenna technology produces significant increases in spectral efficiency and link reliability, and these benefits generally increase as the number of transmission antennas within the MIMO system increases. System operators require more and more capacity for multiple input and multiple output (MIMO) antennas. One way to increase the capacity of such a system is to provide an antenna array that includes multiple antenna units to support dual bands with high gain in diverse radiation pattern directions.

Figure 1:
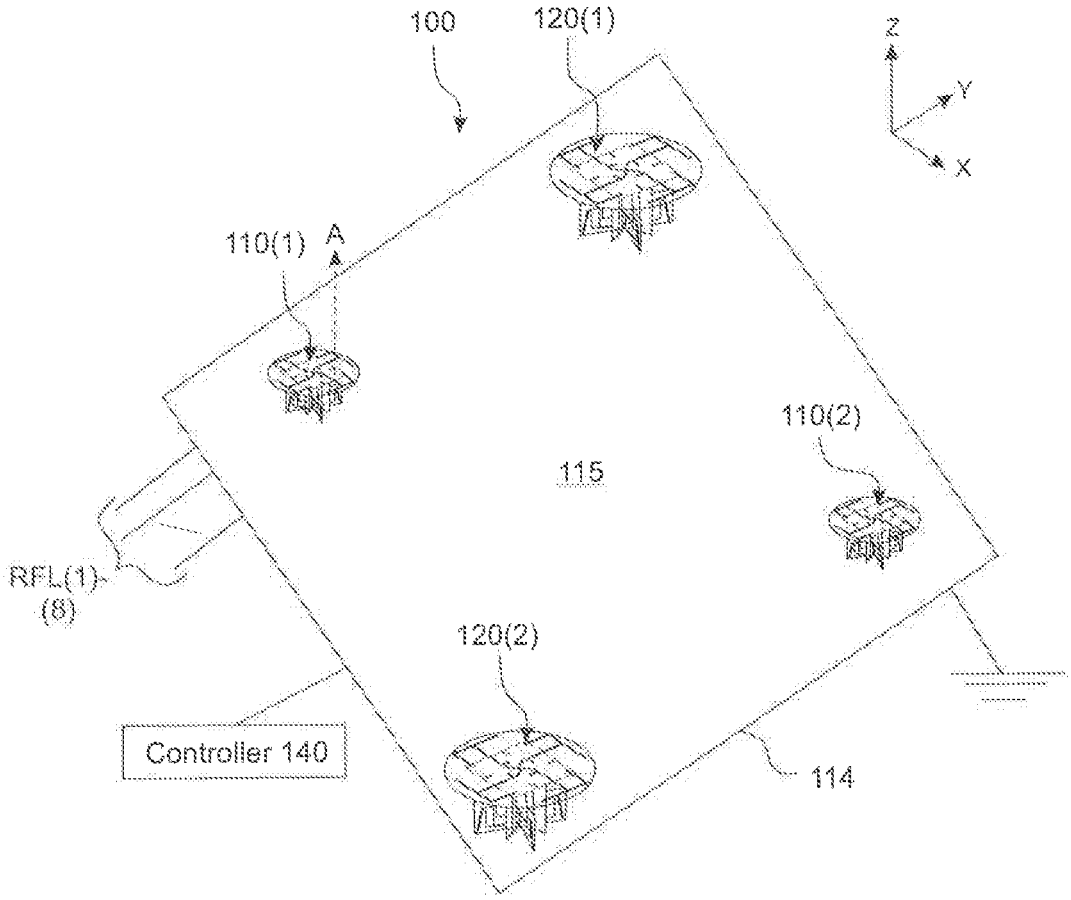
FIG. 1 is a perspective view of an antenna array according to example embodiments.
Figure 2:
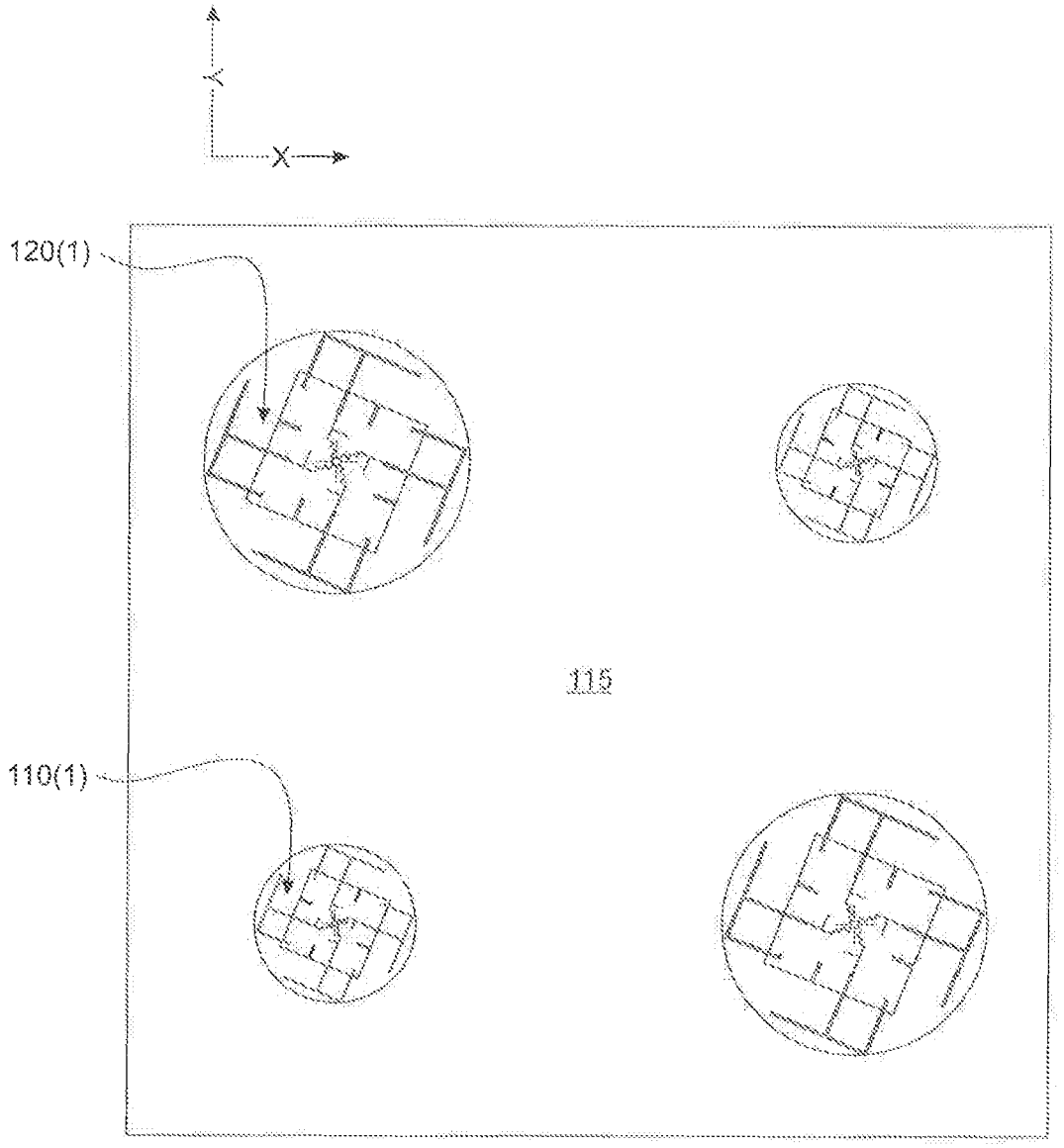
FIG. 2 is a top plan view of the antenna array of FIG. 1.

FIGS. 1 and 2 illustrate perspective and top views of an independently configurable dual band antenna array 100 with configurable radiation patterns, in accordance with example embodiments. The antenna array 100 includes a planar reflector element 114 that supports a set of first antenna units 110(1), 110(2) (referred to generically as first antenna units 110) and a set of second antenna units 120(1), 120(2) (referred to generically as second antenna units 120). The antenna units 110 and 120 all extend from the same side (referred to herein as the top surface 115) of the reflector element 114 and are centrosymmetrically arranged in alternating fashion around a central area of the top surface 115 of reflector element 114. In an example embodiment the reflector element 114 is a multi-layer printed circuit board (PCB) that includes a conductive ground plane layer with a ground connection, one or more dielectric layers, and one or more layers of conductive traces for distributing control and power signals throughout the reflector element 114. By way of non-limiting example, in one possible configuration the reflector element is a 200 mm by 200 mm square, although several other shapes and sizes are possible.

In example embodiments the first antenna units 110 are configured to emit or receive wireless radio frequency (RF) signals within a first RF band and the second antenna units 120 are configured to emit or receive wireless RF signals within a second RF band. For example, in some embodiments the antenna array 100 is used to support WiFi communications, with the first antenna units 110 configured to operate in the 5 GHz frequency band and the second antenna units 120 configured to operate in the 2.4 GHz frequency band.

In the illustrated example, the antenna array 100 includes two 5 GHz antenna units 110(1), 110(2), positioned at two corners of the reflector element 114 along a diagonal of the front surface 115, and two 2.4 GHz antenna units 120(1), 120(2), positioned at the other two corners of the reflector element 114 along the other diagonal of the front surface 115. The 2.4 GHz antenna units 120 are substantially centrosymmetrical with respect to each other about the central area of the front surface 115 and the 5 GHz antenna units 110 are centrosymmetrical with respect to each other about the central area of the front surface 115, as illustrated in FIGS. 1 and 2. In different example embodiments, the number of antenna units operating at each frequency band could be less than or greater than 2, and the relative locations and orientations could be different than that shown in the Figures. Furthermore, the operating frequency bands could be different than the 2.4 GHz and 5 GHz bands that are referenced herein.

Figure 3:
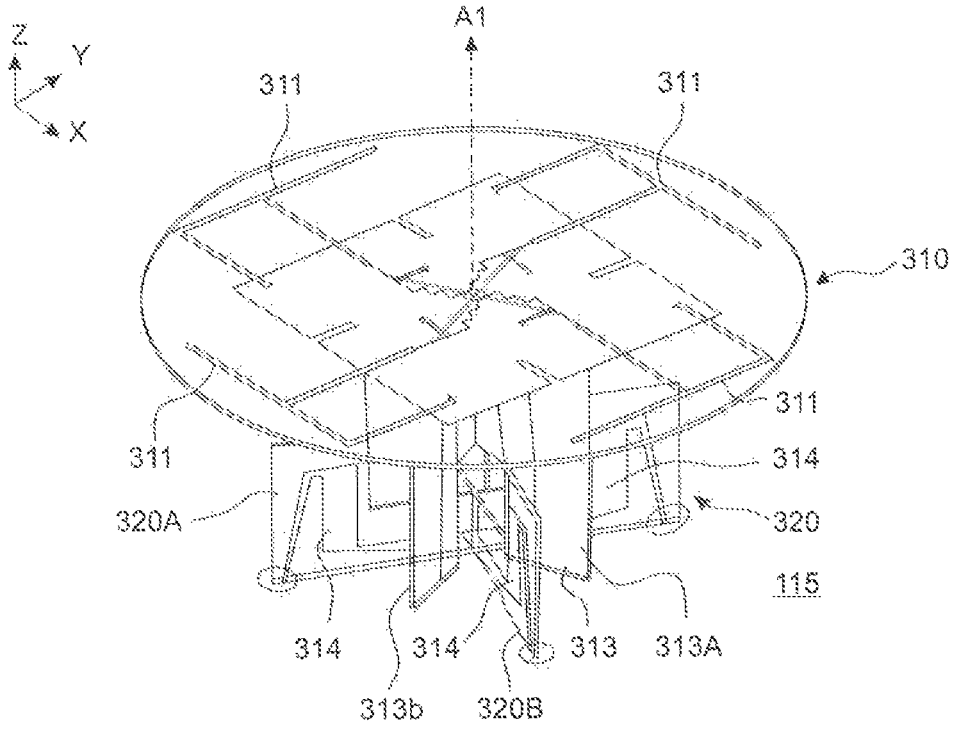
FIG. 3 is a perspective view of a 5 GHz band antenna unit of the antenna array of FIG. 1.

In the illustrated embodiment the configuration of the 5 GHz band antenna units 110(1), 110(2) is substantially identical to that of 2.4 GHz band antenna units 120(1), 120(2), except that the dimensions of each antenna unit 120 are scaled-up compared to those of each antenna unit 110 in order to target the larger wavelength of the 2.4 GHz band as opposed to the shorter wavelength of the 5 GHz band. In this regard FIG. 3 shows an example architecture that can be applied to both antenna units 110 and 120 according to example embodiments. Each antenna unit 110, 120 includes co-located, electrically isolated first and second antennas 310 and 320 that are disposed on reflector element 114. As will be explained in greater detail below, in example embodiments the first antenna 310 includes four inverted-F antenna (IFA) elements 311 that are disposed on a planar, horizontal substrate 312. The substrate 312 is supported by a support structure 313 in a plane spaced apart from and parallel to the top surface 115 of reflector element 114. The second antenna 320 includes two legs 320A, 320B that each support a pair of folded monopole-type antenna elements 314. The legs 320A, 320B intersect at right angles at a central antenna unit axis A1 that is normal to the reflector element 114 (e.g. the axis A1 extends in the vertical Z direction in the coordinate system illustrated in the Figures).

The first and second antennas 310 and 320 provide independently configurable radiation patterns, with the four IFA elements 311 of the first antenna element 310 being configurable to emit or receive RF signals polarized with either omni-directional radiation pattern or directional radiation pattern, and the four monopole elements 314 of second antenna element 320 are also configurable to emit or receive RF signals polarized with either omni-directional radiation pattern or directional radiation pattern. Thus, both of the antennas 310, 320 of antenna unit 110, 120 can be configured into either omni-directional radiation pattern or directional radiation pattern modes independently of each other.

In the embodiment shown in FIGS. 1 and 2, the two 5 GHz antenna units 110(1), 110(2) and the two 2.4 GHz antenna units 120(1), 120(2) all have a similar orientation on the reflector element 114. However, in other embodiments one or more of the units may have different radiation pattern orientations—for example one of the antenna units 110(1) may be rotated 90 degrees about its vertical axis relative to the unit 110(2).

Accordingly, in the illustrated embodiment of FIGS. 1 and 2, the antenna array 100 includes a total of eight independent antennas. In one embodiment, as shown in FIG. 1, eight independent conductive RF lines (RFL(1)-RFL(8)) are connected to the antenna array 100 to provide each antenna 310, 320 of each antenna unit 110(1), 110(2), 120(1), 120(2) with its own respective RF line. For example, the first antenna 310 of the antenna unit 110(1) is connected to RF line RFL(1) and the second antenna 320 of the antenna unit 110(1) is connected to RF line RFL(2). In example embodiments, the RF lines RFL(1)-(8) each include a coaxial line having a signal conductor that is electrically connected to a respective signal path that extends through the reflector element 114 and is connected to an RF port for a corresponding antenna 310, 320.

Configuring the two antennas 310, 320 of the antenna units 110, 120 to emit or receive RF signals with either omni-directional radiation pattern or directional radiation pattern is controlled by an antenna controller 140 (FIG. 1). The antenna controller 140 could for example include a microprocessor and a storage element that stores instructions that configure the microprocessor to operate to selectively control tunable elements that, as described in greater detail below, are provided at each of the antennas 310, 320.

The antenna units 110, 120 can take a number of different possible configurations. An example configuration for a horizontally oriented first antenna 310 that can be used in antenna units 110, 120 will now be described in greater detail with reference to FIGS. 4A to 4C. As previously noted, in example embodiments the first antenna 310 includes four inverted-F antenna (IFA) elements 311 that are disposed on a horizontal substrate 312 that is supported by support structure 313. In example embodiments, the support structure 313 is formed from co-located, vertical support legs 313A and 313B, that are perpendicular to each other and bisect each other at vertical axis A1.

In examples, substrate 312 and support legs 313A and 313B are each formed from printed circuit boards (PCBs) that include a dielectric substrate that support one or more conductive regions. In at least some example embodiments, the PCBs may be 0.5 mm thick, although thicker and thinner substrates could be used. Conventional PCB materials such as those available under the Taconic™ or Arlon™ brands can be used. In some examples, the PCBs may be formed from a thin film substrate having a thickness thinner than around 600 μm in some examples, or thinner than around 500 μm, although thicker substrate structures are possible. Typical thin film substrate materials may be flexible printed circuit board materials such as polyimide foils, polyethylene naphthalate (PEN) foils, polyethylene foils, polyethylene terephthalate (PET) foils, and liquid crystal polymer (LCP) foils. Further substrate materials include polytetrafluoroethylene (PTFE) and other fluorinated polymers, such as perfluoroalkoxy (PFA) and fluorinated ethylene propylene (FEP), Cytop® (amorphous fluorocarbon polymer), and HyRelex materials available from Taconic. In some embodiments the substrates are a multi-dielectric layer substrate.

Figure 4A:
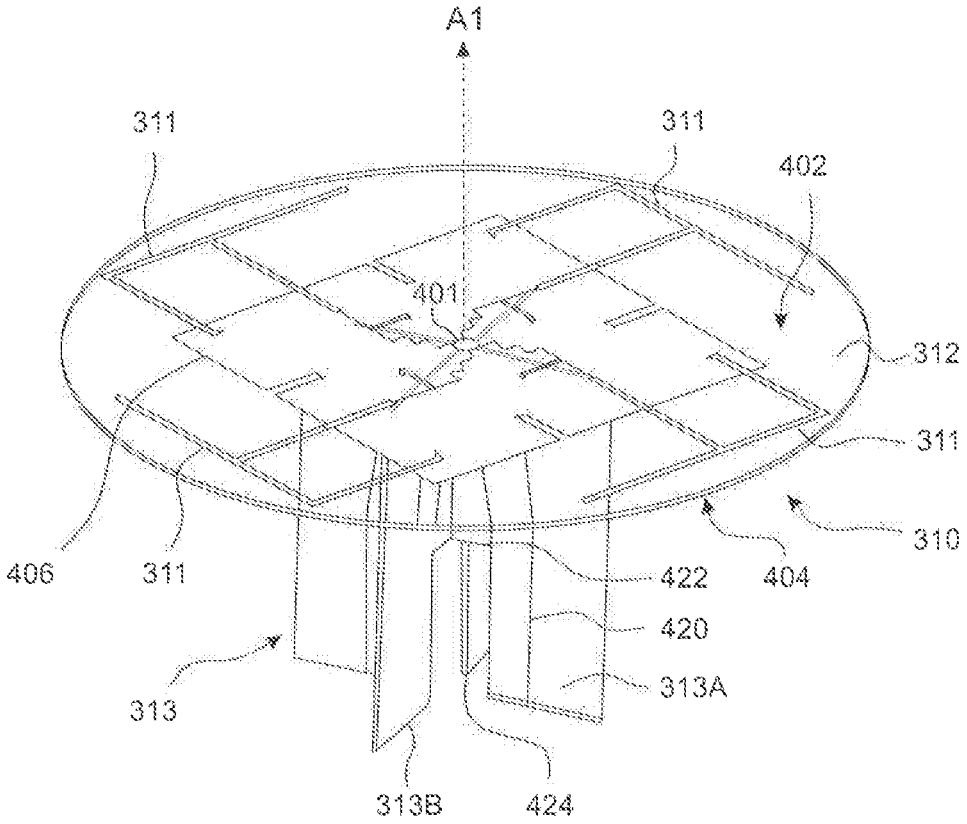
FIG. 4A is a perspective view of a first antenna of the antenna unit of FIG. 3.
Figure 4B:
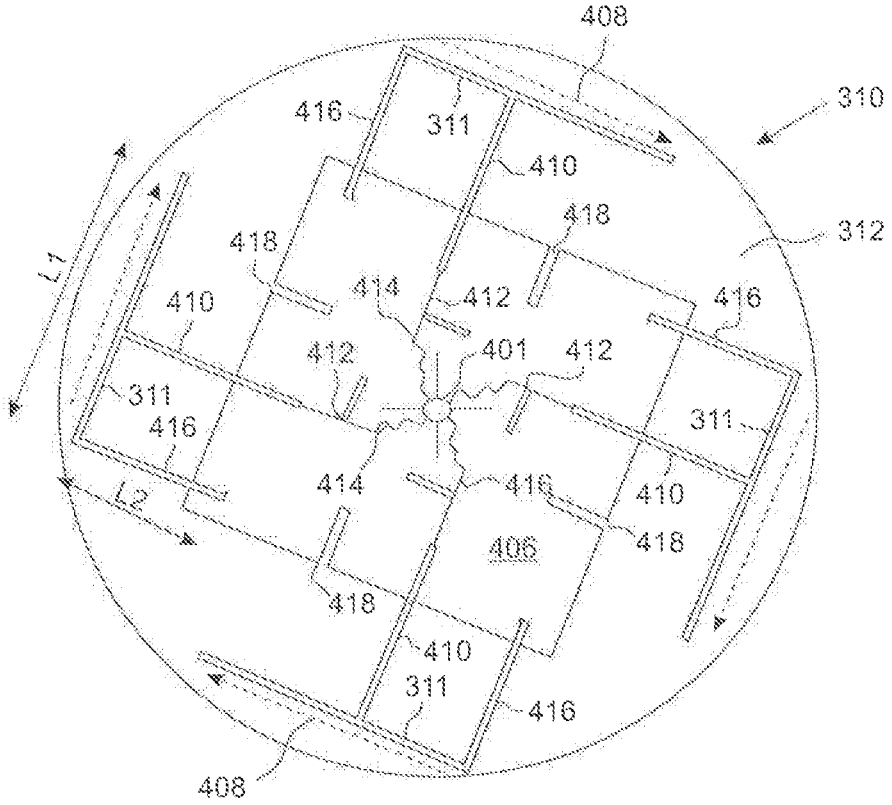
FIG. 4B is a top view of the first antenna element of the antenna unit of FIG. 3.
Figure 4C:
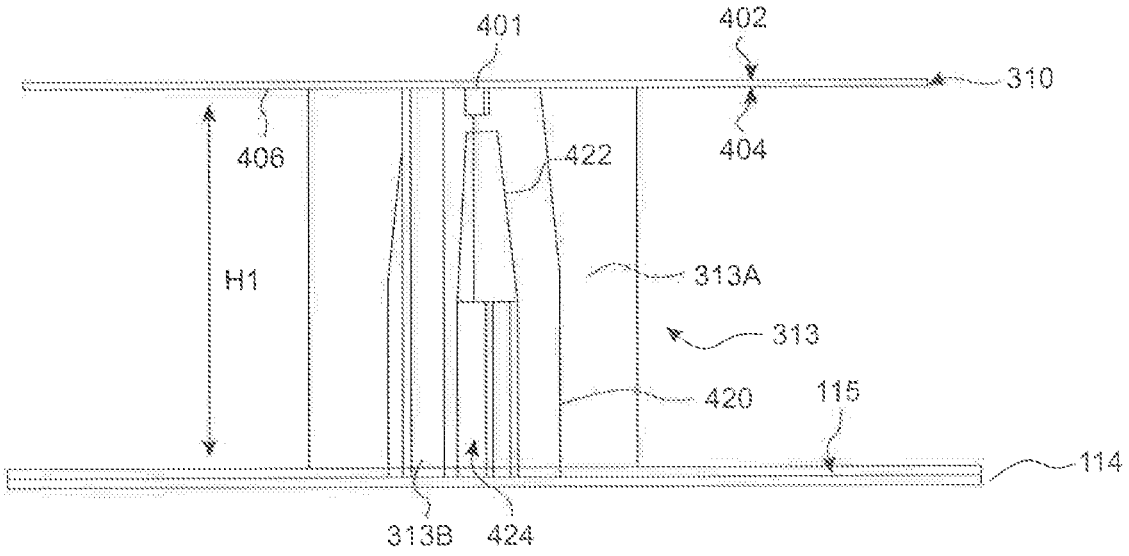
FIG. 4C is a side view of the first antenna element of FIG. 3.

As shown in FIGS. 4A-4C, the four IFA elements 311 are each formed from a conductive material printed on an upper surface 402 of the horizontal substrate 312 that is parallel to and faces away from the upper surface 115 of reflector element 114. A conductive ground plane 402 is formed on the opposite, bottom surface 404 of the substrate 312, facing towards the reflector element 114. In the Figures, substrate 312 is shown as being transparent for the purpose of illustrating the components of the described embodiment. The four IFA elements 311 are disposed centrosymmetrically on the substrate 312 around a central RF port 401, with each IFA element 311 rotated 90 degrees relative to its adjacent IFA elements. Arrows 408 in FIG. 4B illustrate the directions of electric field radiation pattern of the IFA elements 311. The RF signal line 410 of each IFA element 311 is connected by a respective microstrip signal path 414 formed on substrate 312 to the central RF port 401. A tunable element 412 is provided on each of the signal paths 414 that enables each of the IFA elements 311 to be selectively coupled to or decoupled from the RF port 401. The shorting lines 416 of each of the elements are connected by respective conductive paths that extend through the substrate 312 to the ground plane 406.

In example embodiments, the tunable element 412 may selectively couple or decouple the IFA elements 311 by creating a virtual, RF open circuit or closed circuit, such as with the use of PIN diodes. Alternatively, in example embodiments, the tunable element 412 may selectively couple or decouple the IFA elements 311 by creating a physical open circuit or closed circuit, such as with the use of MEMS devices.

In example embodiments, the ground plane 406 is centrosymmetrical about and electrically isolated from the central RF port 401. In the illustrated embodiment, the ground plane 406 is rectangular and includes slots that extend inward on each of its four sides in order to reduce coupling between the IFA elements 311. Each side edge of the ground plane 406 runs parallel to the elongate resonating element of a respective IFA element 311.

The IFA elements 311 and the microstrip signal paths 414 may be formed from conductive material such as copper or a copper alloy, or alternatively, aluminum or an aluminum alloy, that have been printed onto the first surface 402 of the substrate 312. Additionally, the centrosymmetrically shaped ground plane 406 may be formed from conductive material such as copper or a copper alloy, or alternatively, aluminum or an aluminum alloy, that have been printed onto the second surface 404 of the substrate 312. In example embodiments, tunable elements 412 may include PIN diodes or Micro-Electro-Mechanical System (MEMS) devices.

FIG. 4C shows a side view of legs 313A and 313B of the support structure 313 of antenna 310. The PCBs that form support legs 313A and 313B each include a conductive ground layer, as well as conductive control lines 420 and one or more conductive RF signal paths 422. The conductive ground layer connects ground plane 406 of the horizontal substrate 312 to a ground layer of reflector element 114. In an example, the support structure 313 supports four independent control lines 420, each of which is operatively connected at an upper end to a respective one of the tunable elements 412 and at its opposite end to a respective control line provided on the reflector element 114 and electrically connected to controller 140. In some examples, each support leg 313A and 313B includes two control lines 420. The RF signal paths 422 in support structure 313 are electrically coupled to RF port 401 at an upper end, and coupled at their opposite ends through a signal path in the reflector element 114 to one of the eight RF lines (for example RFL(1).

In an example embodiment, the vertical support legs 313A and 313B have cooperating slots along the central axis A1 that allows them to connect to each other, and they also each include centrally located a downwardly opening void or slot 424 that allows the structure of the first antenna 312 to be placed over a central part of the structure of the second antenna 320. The ground planes, control lines 420 and RF signal path 422 on the substrate 400 of the support legs 313A, 313B are electrically isolated with respect to each other, and may be formed from conductive material such as copper or a copper alloy, or alternatively, aluminum or an aluminum alloy, that have been printed onto the substrate of the antenna support legs 313A, 313B.

Accordingly, in example embodiments, each of the four IFA elements 311 of the antenna 310 are connected to a common RF line (for example RFL(1)) through a respective tunable element 412. The four tunable elements 412 are in turn each individually connected to controller 140, such that each of the four IFA elements 311 of the antenna 310 can be selectively activated by coupling them to or decoupling them from the RF signal line, enabling the antenna 310 to be controlled to emit or receive RF signals using all of the IFA elements 311 together in an omnidirectional mode or selectively using the IFA elements 311 in a directional mode. In the illustrated example, controller 140 is used to control a connection between each IFA element 311 and the central RF port 401, exciting the IFA elements 311 to emit or receive signals with diverse radiation pattern in either omni-directional radiation pattern direction or directional radiation pattern. As illustrated by the electric field radiation pattern arrows 408, the four symmetrical IFA elements 311 facilitate electric field vectors that form a circle, cancelling the radiation in the direction normal to the ground plane of the reflector element 114 as well as increasing radiation at angles close to the ground plane of the reflector element 114. Such a configuration can be beneficial for increasing antenna radiation range.

Referring to FIG. 4B, in example embodiments, the IFA elements 311 of an antenna 320 are each identical and each have a combined back length L1 plus shorting line length L2 of about ¼ of the operating wavelength $\lambda_1$, and the rectangular ground plane 406 has a side edge length of about ½ of the operating wavelength $\lambda_1$. Additionally, in example embodiments, the antenna support structure 313 supports the substrate 312 of antenna 310 a distance H1 from the reflector element 114, where H1 is about $H1 \approx \lambda_1/2$ for a 5 GHz frequency band antenna and about $H1 \approx \lambda_1/4$ for a 2.4 Ghz frequency band antenna. $\lambda_1$ is the operating wavelength near the lower end of the 5 GHz or 2.4 GHz frequency band for antenna unit 110 or 120 respectively. In some example embodiments, "about" can include a range of +/−15%.

An example embodiment of second antenna 320 will now be described in greater detail with reference to FIGS. 5A to 5E. As indicated above, the second antenna 320 includes two legs 320A, 320B that each support a pair of folded monopole-type antenna elements 314. The legs 320A, 320B each have a generally U-shaped profile and intersect at right angles at a central antenna unit axis A1 that is normal to the reflector element 114. The legs 320A and 320B are each formed from a respective PCB that includes a dielectric substrate 502A, 502B. Regarding the leg 320A, as best seen in FIG. 5B, a conductive pattern or region 501 is formed on one side of the generally U-shaped dielectric substrate 502A that is symmetrical about antenna unit axis A1. The substrate 504 has mounting tabs 508, 510 formed along its back edge 511 for mating with corresponding slots that are formed in the reflector element 114. The conductive region 501 is a conductive layer formed on a surface of the substrate 502A that is perpendicular to the front surface 115 of reflector element 114. Conductive region 501 is connected to a central microstrip RF signal port 506 that is electrically isolated from the ground plane of the reflector element 114.

Conductive region 501 includes two identical portions that extend in opposite directions outward from central connector 506. Each portion forms one of the folded ¼ wavelength monopole antenna elements 314, with each antenna element 314 including: a first elongate RF signal line 512 that extends along surface 503 generally parallel to back edge 511 to a RF resonating section 514 that extends at a right angle from the first section 512 towards a top edge 516 of the substrate 504 to a connecting line section 518 that extends generally parallel to the front edge 516. The connecting line section 518 extends to a shorting line 520 that folds back to extend to the back edge 511 of the substrate 502A. In example embodiments, RF resonating section 514 has a height H2 of about ¼ of the operating wavelength $\lambda_1$, and each U-shaped leg 320A has a width of about ½ of the operating wavelength $\lambda_1$.

Leg 320B has a similar configuration to leg 320A, with the exception of the central regions of the legs that are respectively slotted to cooperate with each other so that the legs can bisect each other at a perpendicular angle along central axis A1. In this regard, as seen in FIG. 5C, the first monopole leg 320A includes a conductive pad 5308 on its reverse surface that is electrically connected to RF signal port 506, and an upwardly opening slot 5304 along the central axis A1 for receiving a portion of the second monopole leg 320B. The second monopole leg 320B has the corresponding downwardly opening slot 5306 along central axis A1 for receiving a portion of the first monopole leg. When the monopole legs 320A and 320B are connected at 90 degree angle along axis A1, the conductive regions 502A, 502B are located at right angles to each other and are bisected along axis A1. One antenna element 314 of leg 320B is electrically and physically connected (for example by solder) to the conductive region 518 of the leg 320A, and the other antenna element of the second leg 320B is electrically and physically connected (for example by solder) to the conductive pad 5308, such that all four antenna elements 314 are electrically connected to RF signal port 306.

Antenna elements 314 and the other conductive portions on legs 320A, 320B may be formed from a conductive material such as copper or a copper alloy, or alternatively, aluminum or an aluminum alloy, that have been printed onto the substrate 502A, 502B.

Figure 5A:
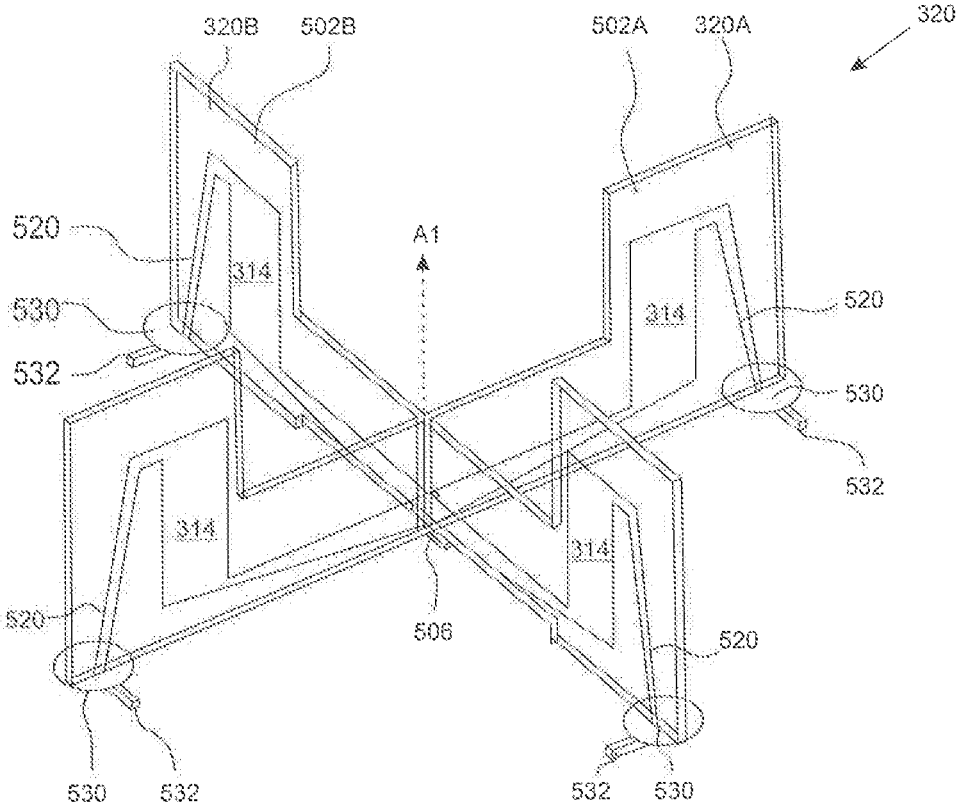
FIG. 5A is a perspective view of a second antenna of the antenna unit of FIG. 3.
Figure 5B:
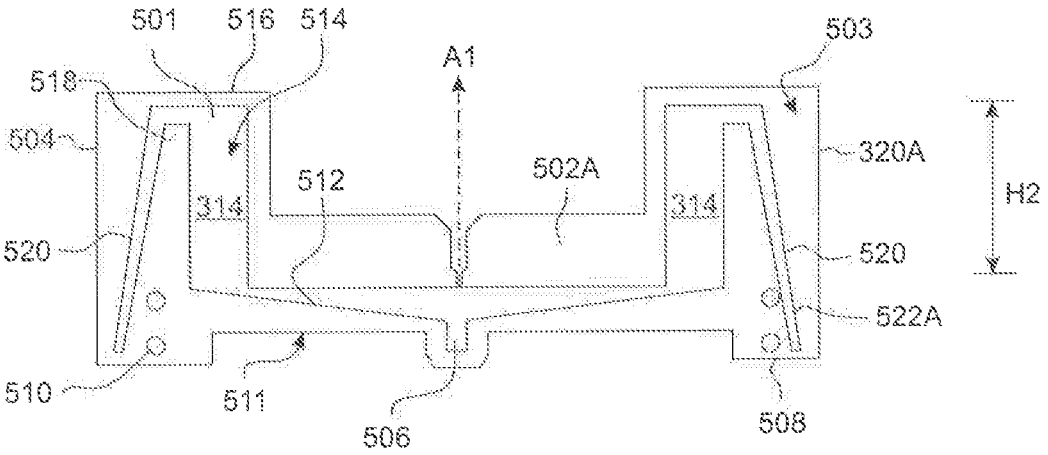
FIG. 5B is a front side view of one leg of the second antenna of the antenna unit of FIG. 3.
Figure 5C:
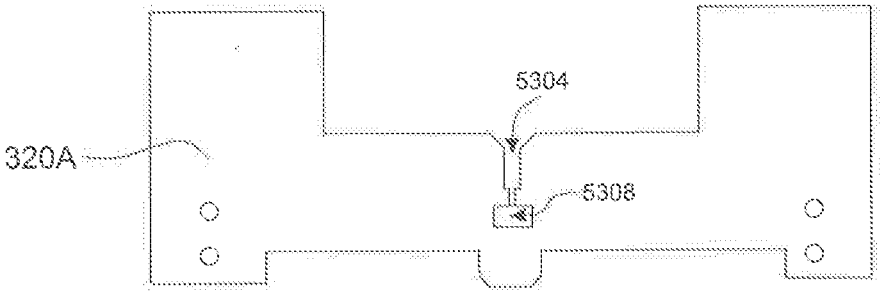
FIG. 5C is a back side view of the second antenna leg of FIG. 5B.
Figure 5D:
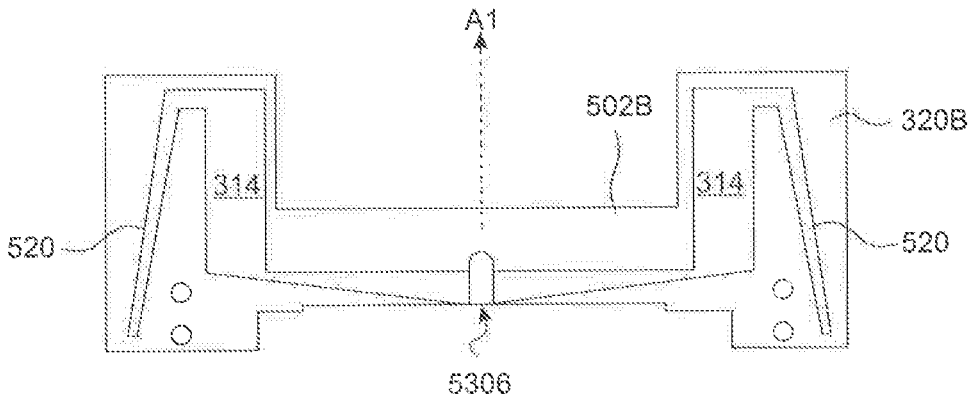
FIG. 5D is a front side view of another leg of the second antenna of the antenna unit of FIG. 3.
Figure 5E:
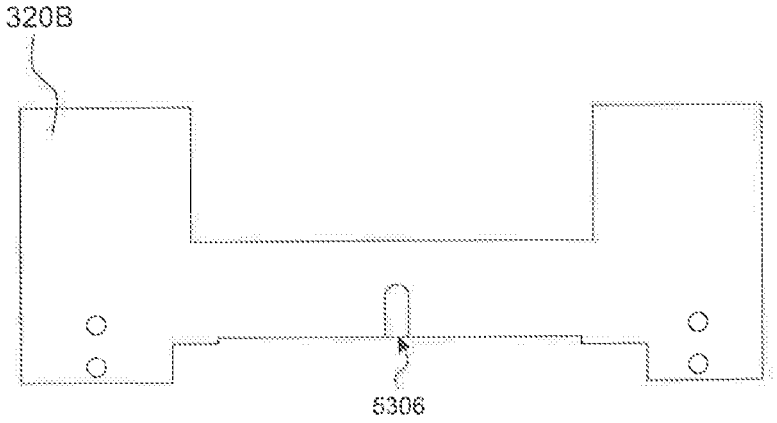
FIG. 5E is a back side view of the second antenna leg of FIG. 5D.

Referring to FIG. 5A, when antenna element 320 is mounted on reflector element 114, the central RF signal port 506 is connected to one of the RF lines (for example RFL(2), such that all four antenna elements 314 of antenna 320 are electrically connected to the same RF feed. In the illustrated example, the ground line 520 of each antenna element 314 is connected through a respective tunable element 530 to the ground plane layer of the reflector element 114, and the respective tunable elements 530 are each connected by a respective control line 532 that extends through the reflector element 114 to controller 140. The tunable elements 530 enable each of the antenna elements 314 to be selectively coupled to or decoupled from ground, and may include for example PIN diodes or MEMS devices.

Accordingly, in example embodiments, the ground line 520 of each of the four folded monopole antenna elements 314 of the antenna 320 are connected to a common ground plane through a respective tunable element 530. The four tunable elements 530 are in turn each individually connected to controller 140, such that each of the four antenna elements 314 can be selectively activated by coupling them to or decoupling them from ground, enabling the antenna 314 to be controlled in an omni-directional mode or in a directional mode. In the illustrated example, controller 140 is used to control a connection between each antenna element 314 and ground, exciting the elements 314 to emit or receive signals with diverse radiation pattern in either omni-directional radiation pattern direction or directional radiation pattern.

In example embodiments, the tunable element 530 may selectively couple or decouple the antenna elements 314 by creating a virtual, RF open circuit or closed circuit, such as with the use of PIN diodes. Alternatively, in example embodiments, the tunable element 530 may selectively couple or decouple the antenna elements 314 by creating a physical open circuit or closed circuit, such as with the use of MEMS devices.

As shown in FIG. 3, first and second antennas 310 and 320 are co-located on the surface 115 of reflector element 114 to form an antenna unit 110, 120. In the illustrated example, the support legs 313A and 313B of first antenna 310 meet at a right angle at the axis A1 with one leg 313A rotated clockwise +45 degrees relative to the second antenna leg 320A and the other first antenna leg 313B is rotated clockwise +45 degrees relative to the second antenna leg 320B such that the legs are symmetrically spaced round the common antenna unit axis A1. The upwardly U-shaped configuration of the second antenna legs 320A, 320B provides space that cooperates with the downwardly opening U-shaped voids 424 in first antenna legs 313A, 313B to physically isolate the first antenna 310 and the second antenna 320 from each other.

In example embodiments the antenna elements 314 of antenna unit 310, 320 are vertically oriented at a right angle relative to reflector element 114, with the pair of antenna elements 310 on leg 320A and the antenna elements on leg 320B being perpendicular planes relative to each other. The IFA elements 311 extend in a horizontal plane parallel to reflector element 114.

In the embodiment described above, the antenna array 100 can support up to 8 RF streams or channels using the four antenna units 110(1), 110(2), 120(1), 120(2), with 4 of the streams operating in a first frequency band and 4 of the streams operating in a second frequency band. Furthermore, by controlling the tunable elements that are attached to each of antenna elements 311, 314, the radiation pattern of each RF stream can be controlled, providing independently selectable directive patterns for each RF stream and each operating frequency. In addition, configurations of the antenna array not only reduce gain at boresight but also increase high performance with high gain near horizontal plane for each stream.

In the examples described above, the selective excitability of the antenna elements is provided in first antenna 310 by the use of tunable elements that operatively connect the RF signal lines of IFA elements 311 to RF signal port, whereas in second antenna 320, the selective excitability is provided by the use of tunable elements that operatively connect the shorting lines of the folded monopole antenna elements 314 to ground. In alternative example embodiments, the location of the tunable elements in antennas 310, 320 can be changed—for example the tunable elements could be moved to the IFA element shorting line from the RF signal line in the case of first antenna 310, and from the shorting line to the RF signal line in the case of second antenna 320.

Figure 6:
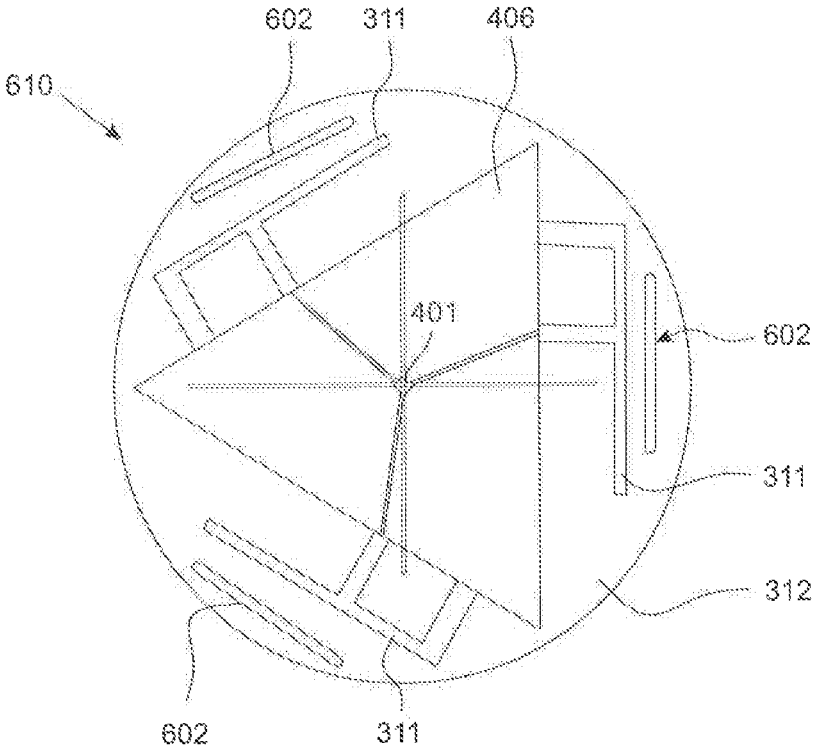
FIG. 6 is a top view of an antenna that can be used with the antenna unit of FIG. 3 according to an alternative example embodiment.

In example embodiments, the number of antenna elements used in each of the first and second antennas 310, 320 could be more then or less than four controllable antenna elements. For example, in an alternative embodiment, second antenna 320 could be formed from three folded monopole elements 314 spaced at 120 degree intervals about central axis A1. Similarly, first antenna 310 could also include only three IFA elements 311, and in this regard FIG. 6 shows an alternative example of a first antenna 610 that is substantially identical to antenna 310 except that antenna 610 only includes three individually controllable IFA elements 311 rather than four. In the example of FIG. 6, the IFA elements are centrosymetrically located about axis A1 at 120 degree spacing relative to each other, and ground plane 406 is triangular with each side running parallel to the elongate resonating element of a respective IFA element 311.

As illustrated in FIG. 6, in some example embodiments, outboard parasitic conductors 602 are provided on the substrate 312 to provide enhanced horizontal pattern gain. In the example of FIG. 6, three electrically isolated parasitic conductors 602 are located on the upper surface of substrate 312 to function as a parasitic director. As shown in FIG. 6, each parasitic conductors 602 is an elongate conductive strip that is located outward (relative to central axis A1 and RF port 401) of a respective IFA element 311 and parallel to the radiation pattern direction of the respective IFA element 311. Although shown in the context of a three IFA element antenna 610, parasitic conductors 602 could also be used in the four IFA element antenna 310 described above, with a respective parasitic conductor 602 being located outward of and parallel to each of the four IFA elements 311.

Figure 7A:
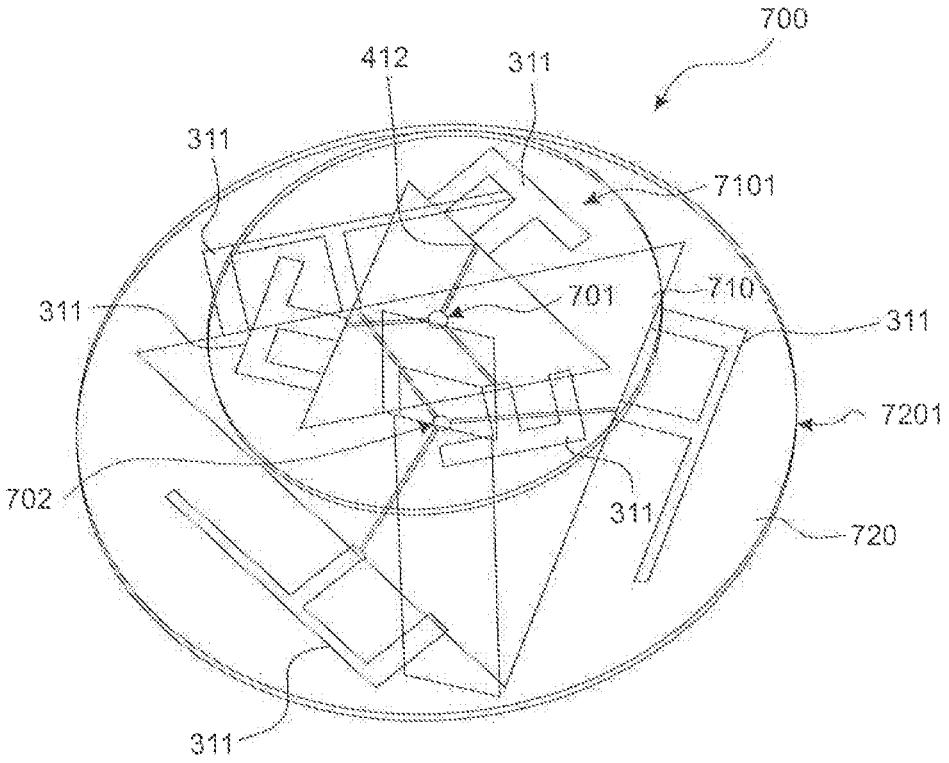
FIG. 7A is a perspective view of a stacked antenna unit that can be used in the antenna array of FIGS. 1 and 2 according to further example embodiments.
Figure 7B:
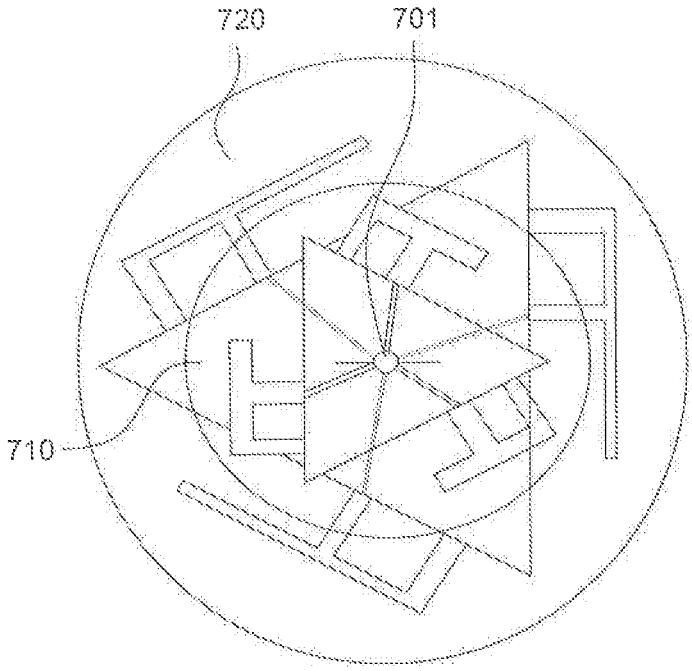
FIG. 7B is a top view of the stacked antenna unit of FIG. 7A.
Figure 7C:
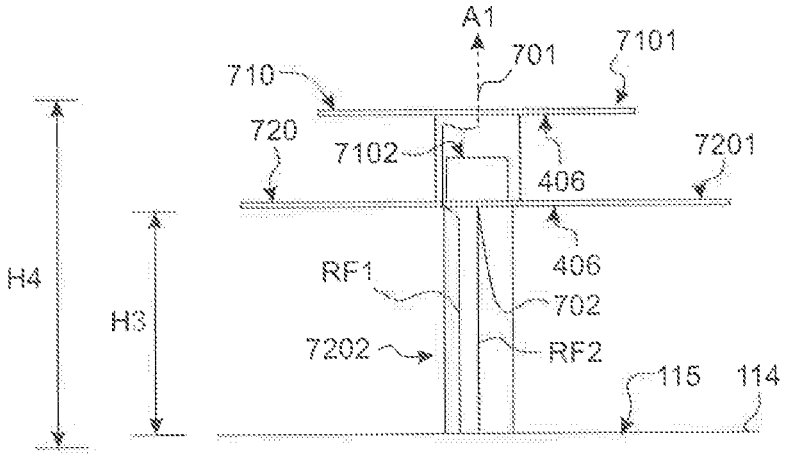
FIG. 7C is a side view of the stacked antenna unit of FIG. 7A.

In the embodiments described above, each antenna unit 110, 120 has included two co-located antennas 310, 320 that both operate in the same band (for example 5 GHz for antenna unit 110 and 2.4 GHz for antenna unit 120), with the IFA elements 311 in antenna 310 being oriented in an orthogonal plane relative to the folded monopole antenna elements 314 in antenna 320. However, in alternative example embodiments the co-located antennas in each antenna unit may be configured to operate in different bands or have antenna elements that are oriented in parallel planes, or both. In this regard, FIGS. 7A, 7B and 7C show an example embodiment of an alternative structure for a co-located antenna unit 700 that can be used in array 100 in place of one or more antenna units 110, 120. Co-located antenna unit 700 is a stacked antenna unit that includes a first antenna 710 that operates at a first frequency band, and a second antenna 720 that operates at a second frequency band. Each of first antenna 710 and second antenna 720 has a configuration similar to that of first antenna 310 or 610 described above. In the illustrated example, first antenna 710 includes at least three horizontally oriented IFA elements 311 arranged on a PCB substrate 7101 centrosymetrically around a central RF port 701 that is located at central antenna axis A1, with each RF element 311 connected to the central RF port 701 through a respective tunable element 412. Similarly, second antenna 710 includes at least three horizontally oriented IFA elements 311 arranged on a PCB substrate 7201 centrosymetrically around a central RF port 702 that is located at central axis A1, with each RF element 311 connected to the central RF port 702 through a respective tunable element 412.

As best seen in FIG. 7C, The PCB substrates 7101, 7201 of antennas 710, 720 are arranged in a horizontally oriented stacked configuration parallel to each other and parallel to the upper surface 115 of reflector element 114. The second antenna 720 is spaced above the reflector element 114 by a distance H3 and the first antenna 710 spaced above the reflector element 114 by a larger distance H4. The PCB substrate 7101 of second antenna 720 is secured to and supported above the reflector element 114 by a PCB support structure 7202, and the PCB substrate 7101 of first antenna 710 is secured to and supported above the PCB substrate 7201 by a further PCB support structure 7102. The PCB support structure 7202 includes a ground plane that connects the ground plane 406 on the under side of PCB substrate 7201 of second antenna 720 to the ground plane of the reflector element 114. The PCB support structure 7102 also includes a ground plane that electrically connects the ground plane 406 on the under side of PCB substrate 7101 of first antenna 710 to the ground plane of the substrate 7202. A first RF signal path RF1 is provided through PCB support structures 7102, 7201 that connects the RF signal port 701 of the first antenna 710 to a respective one of the RF lines RFL(1) to (8), and a second RF signal path RF2 is provided through PCB support structure 7201 that connects the RF signal port 702 of the second antenna 720 to a further respective one of the RF lines RFL(1) to (8). Although not shown in FIG. 7C, controls paths 420 for the tunable elements 412 are also provided through the PCB support structures 7102, 7201 to allow the antenna controller 140 to selectively excite each of the IFA elements 311.

In the example of FIGS. 7A-7C the first upper antenna 710 is rotated 60 degrees relative to second antenna 720 so that the IFA elements 311 on the upper first antenna 710 are not in vertical alignment with the IFA elements 311 on the lower second antenna 720.

In the example shown in FIGS. 7A-7C, first antenna 710 is configured to operate in the 5 GHz band and accordingly and the dimensions of second antenna 720 are scaled up relative to the first antenna 710 to operate in the 2.4 GHz band. However, in other embodiments, both antennas 710 and 720 could be configured to operate in the same band. Furthermore, in some embodiments, additional antennas for additional RF signals could be added to the antenna unit 700.

In example embodiments, antenna units 700 can be used to replace some or all of the antenna units 110, 120 in antenna array 100, or be added as additional antenna units in antenna array 100. In at least some configurations, embodiments of the antenna array 100 can advantageously accomplish one of more of the following: increase the capacity of a MIMO antennal; efficiently use available real estate and space; reduce the size of an antenna required; reduce gain at boresight; and detect a wide range of RF signals.

Figure 8:
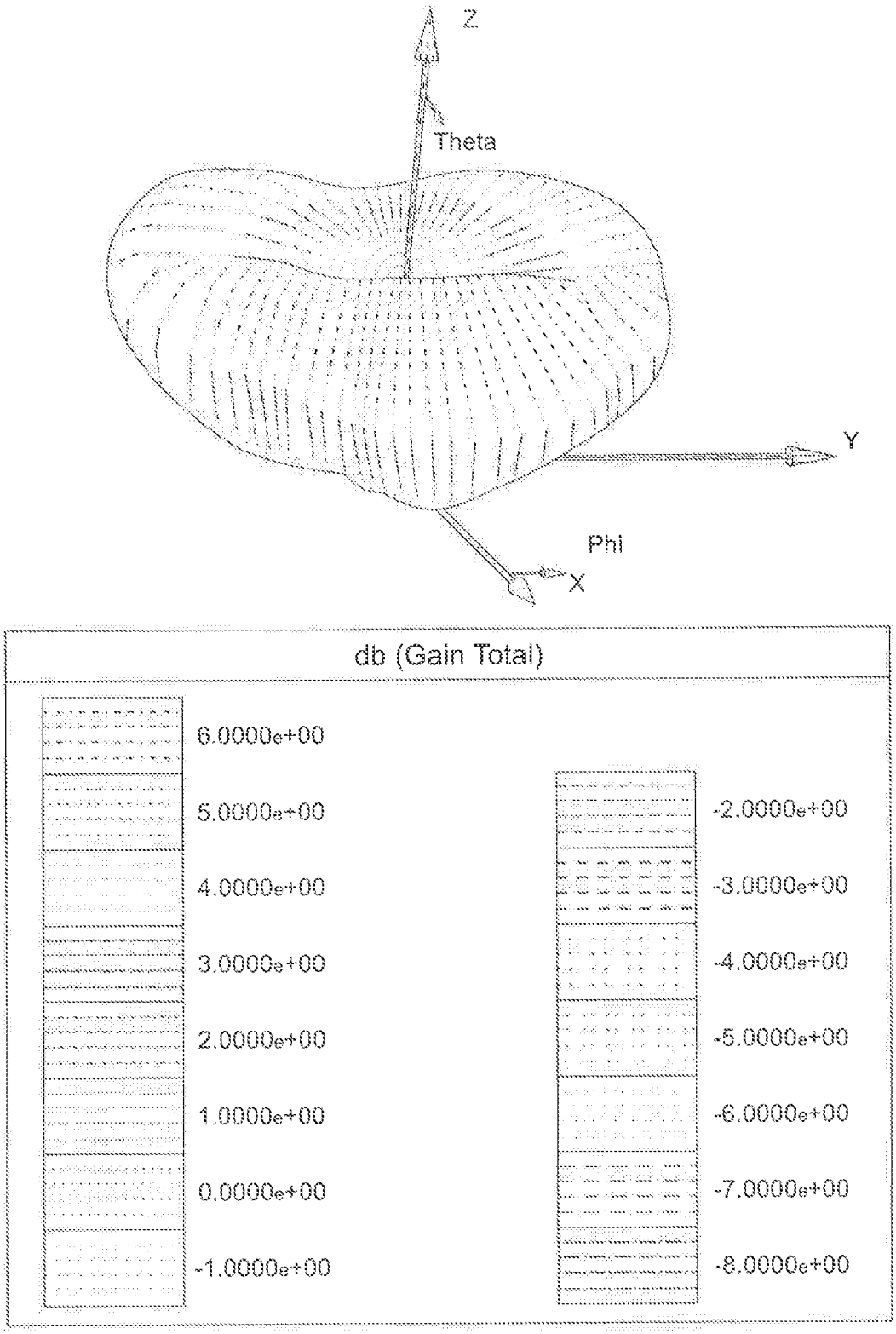
FIG. 8 shows an example of an omni-directional radiation patterns for IFA elements of a 5 GHz antenna unit.
Figure 9:
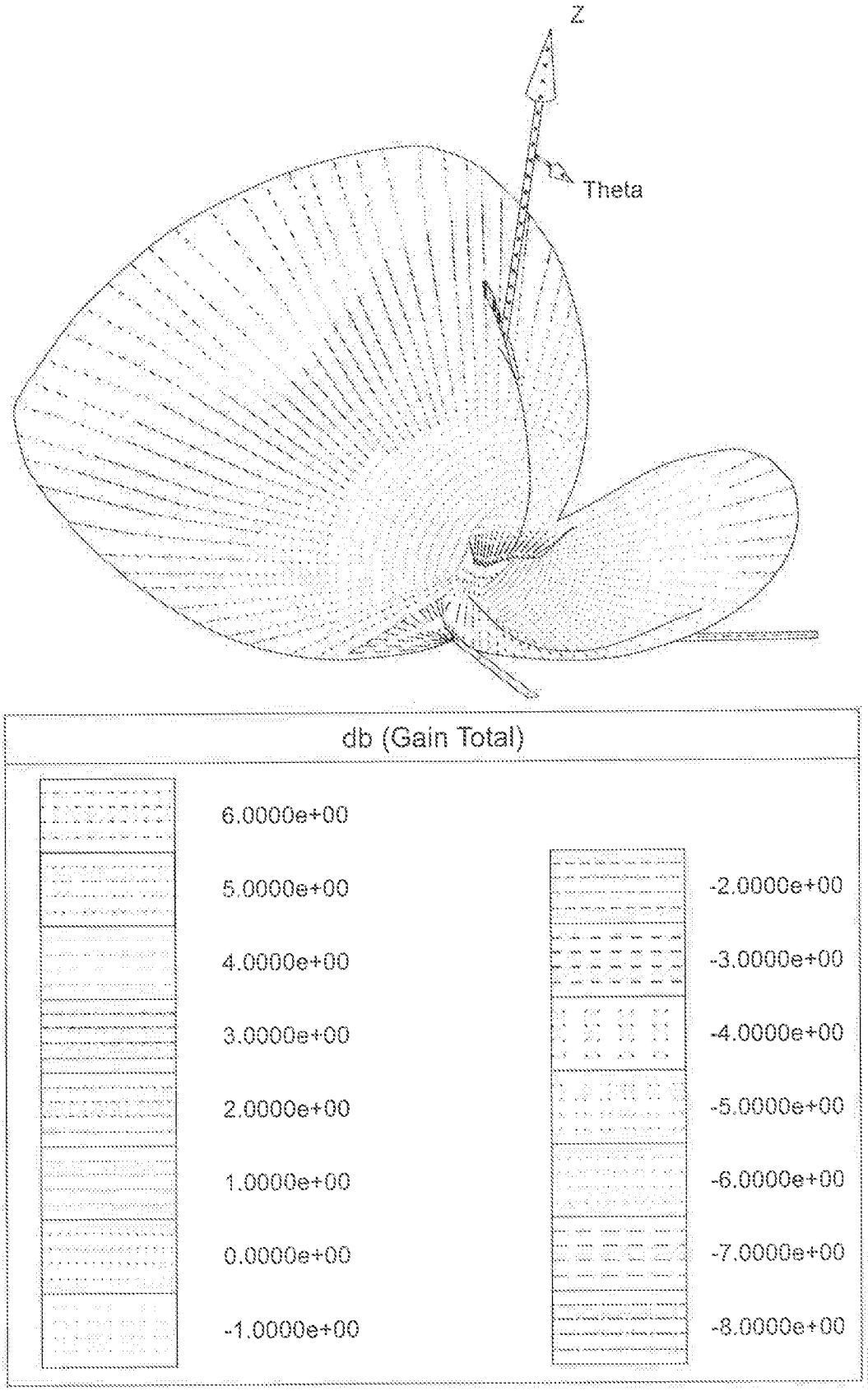
FIG. 9 shows directional radiation patterns of the IFA elements of a 5 GHz antenna unit.
Figure 10:
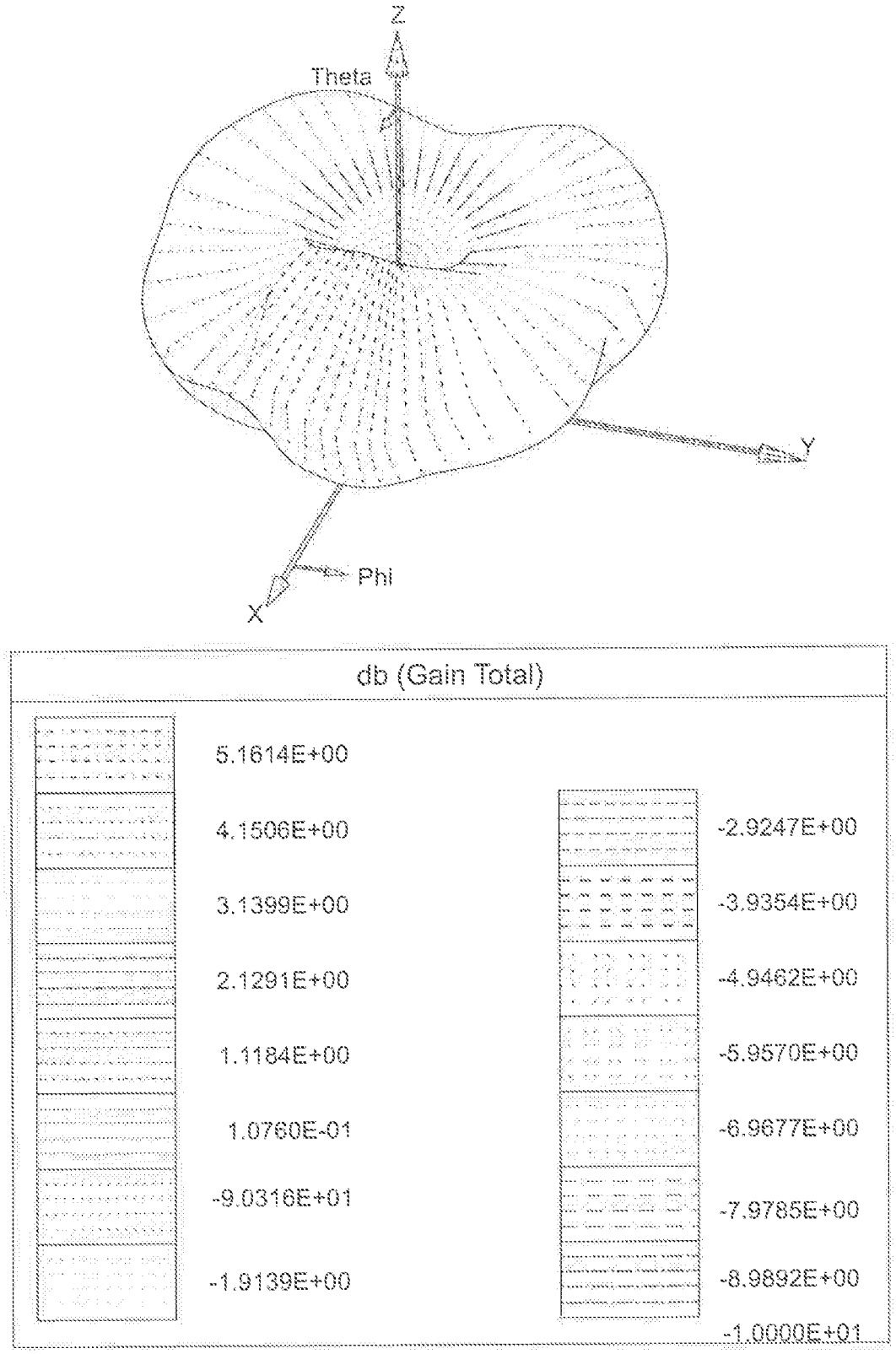
FIG. 10 shows an example of omni-directional radiation patterns of the folded monopole antenna elements of a 5 GHz antenna unit.
Figure 11:
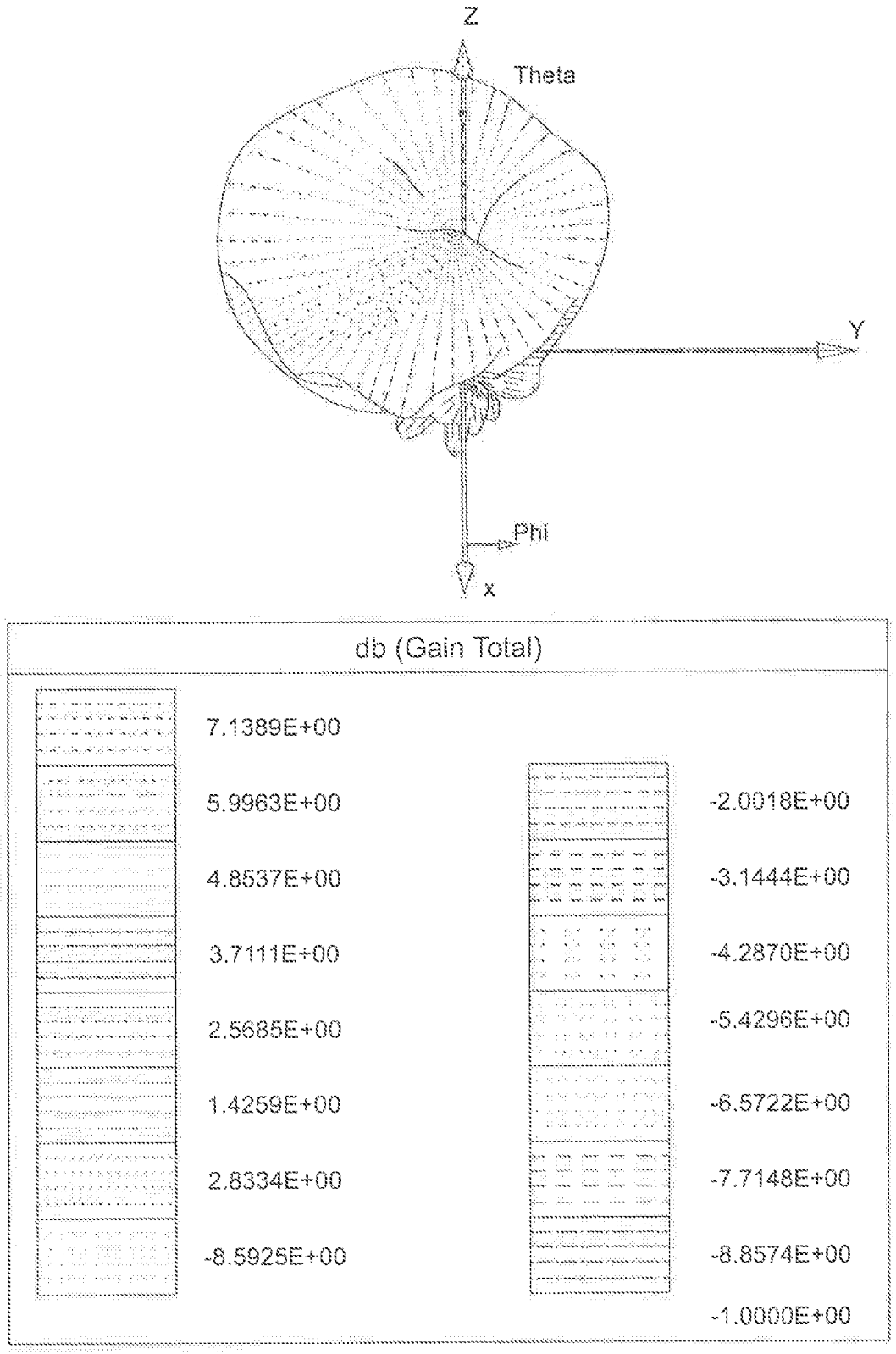
FIG. 11 shows and example of directional radiation patterns of the folded monopole antenna elements of the 5 GHz antenna unit.

FIGS. 8 and 9 show example radiation patterns for the antenna elements of a three IFA 5 GHz antenna unit 610. In particular: FIG. 8 shows an example of a omni-directional radiation pattern for all three IFAs being excited; FIG. 9 shows an example of directional radiation patterns for two of three IFAs being excited. FIGS. 10 and 11 shows example radiation patterns for the folded monopole antenna 320 in the presence of the three IFA 5 GHz antenna unit 610: FIG. 10 shows an omni-directional radiation pattern for the monopole elements 314; and FIG. 11 shows a directional radiation pattern for the monopole elements 314.

For each antenna elements of the antenna units, omni-directional radiation patterns as well as directional radiation patterns are independently configurable on any stream. Embodiments of the invention may be applied to radar system such as automotive radar or telecommunication applications such as transceiver applications in base stations or user equipment (e.g., hand held devices) or access point (AP). In one example embodiment, antenna array 100 is incorporated into a low profile wireless local area network (WLAN) access point (AP). The dimensions described in this application for the various elements of the antenna array 100 are non-exhaustive examples and many different dimensions can be applied depending on both the intended operating frequency bands and physical packaging constraints.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A radio frequency (RF) antenna unit comprising:

a first antenna positioned on a reflector element, the first antenna comprising at least three inverted-F antenna (IFAs) elements that are electrically connected to a first RF signal port and that each have an associated tunable element that controls excitation of the IFA element, the tunable elements being operative to control a radiation pattern direction of the first antenna; and a second antenna co-located on the reflector element with the first antenna, the second antenna comprising a plurality of antenna elements each being a folded monopole antenna element that extends perpendicularly to the reflector element.

2. The RF antenna unit of claim 1 wherein the tunable elements are operative to control excitation of the IFA elements to enable a first mode in which the first antenna has an omni-directional radiation pattern and a second mode in which the first antenna has a directional radiation pattern.

3. The RF antenna unit of claim 2 wherein the IFA elements are arranged symmetrically around a central axis, on a printed surface board (PCB) substrate, and are spaced apart from and parallel to the reflector element.

4. The RF antenna unit of claim 3 wherein the first RF port is centrally located relative to the IFA elements, each IFA element being electrically connected to the first RF signal port through the tunable element associated with the IFA element such that the tunable element can selectively couple and decouple the IFA element to the first RF signal port.

5. The RF antenna unit of claim 4 wherein each IFA element has an associated gain enhancing parasitic conductor that is located adjacent the IFA element on the PCB substrate a further distance from the RF signal port than the IFA element.

6. The RF antenna unit of claim 3 wherein the antenna elements of the second antenna are each connected to a second RF signal port and each have an associated tunable element that controls excitation of the antenna element, the tunable elements being operative to control a radiation pattern direction of the second antenna.

7. The RF antenna unit of claim 6 where the antenna elements of the second antenna are centrosymetrically arranged around the central axis.

8. The RF antenna unit of claim 1 wherein the first antenna and the second antenna are configured to operate in the same frequency band.

9. The RF antenna unit of claim 8 wherein the same frequency band is either a 2.4 GHz band or a 5 GHz band.

10. The RF antenna unit of claim 1 wherein the first antenna comprises four IFA elements and the second antenna comprises four folded monopole antenna elements.

11. The RF antenna unit of claim 7 wherein a shorting line of each monopole antenna element is connected to ground through the tunable element associated with the monopole antenna element.

12. The RF antenna unit of claim 1 wherein the first antenna and the second antenna are configured to operate in different frequency bands.

13. The RF antenna unit of claim 12 wherein one of the frequency bands a 2.4 GHz band and the other frequency band is a 5 GHz band.

14. An antenna array, comprising:

a planar reflector element;

a first antenna unit comprising a first antenna positioned on the reflector element and configured to operate in a first frequency range, the first antenna comprising at least three inverted-F antenna (IFAs) elements electrically connected to a first RF signal port and that each have an associated tunable element that controls excitation of the IFA element;

a second antenna unit comprising a second antenna positioned on the reflector element and configured to operate in a second frequency range, the second antenna comprising at least three inverted-F antenna (IFAs) elements that are electrically connected to a second RF signal port and that each have an associated tunable element that controls excitation of the IFA element; and a controller operatively connected to the tunable elements associated with each of the IFA elements for selectively controlling radiation pattern directions of the first antenna and the second antenna;

wherein each of the first and second antenna units includes a further antenna co-located on the reflector element with a respective one of the first and second antenna, each further antenna comprising a plurality of folded monopole antenna elements each extending perpendicularly to the reflector element.

15. The antenna array of claim 14 wherein the tunable elements are responsive to the controller to control excitation of the IFA elements to selectively enable a first and second mode for each of the first and second antennas, wherein in the first mode the IFA elements are excited collectively to provide an omni-directional radiation pattern and in the second mode the IFA elements are selectively excited to provide a directional radiation pattern.

16. The antenna array of claim 14 wherein:

the plurality of folded monopole antenna elements of the first antenna unit comprising at least three antenna elements electrically connected to a third RF signal port and that each have an associated tunable element that controls excitation of the antenna element;

the plurality of folded monopole antenna elements of the second antenna unit comprising at least three antenna elements electrically connected to a fourth RF signal port and that each have an associated tunable element that controls excitation of the antenna element;

the controller being operatively connected to the tunable elements associated with each of the antenna elements for selectively controlling radiation pattern directions of the further antennas of the first antenna unit and the second antenna unit.

17. The antenna array of claim 16 wherein for each of the first antenna and the second antenna the IFA elements are arranged symmetrically around a central axis, on a printed surface board (PCB) substrate, and are spaced apart from and parallel to the reflector element, wherein: (i) for the first antenna the first RF signal port is centrally located relative to the IFA elements, each IFA element of the first antenna being connected to the first RF signal port through the tunable element associated with the IFA element; and (ii) for the second antenna the second RF signal port is centrally located relative to the IFA elements, each IFA element of the second antenna being connected to the second RF signal port through the tunable element associated with the IFA element.

18. The antenna array of claim 16 comprising two of the first antenna units and two of the second antenna units located symmetrically around a central area of the reflector element and enabling 8 RF signals to be independently polarized.

19. The antenna array of claim 16 wherein the first antenna and second antenna each comprise at least four IFA elements and the further antennas of the first antenna unit and the second antenna unit each comprise at least four folded monopole antenna elements.

* * * * *